United States Patent [19]

Brauner et al.

[11] Patent Number: 4,472,896

[45] Date of Patent: Sep. 25, 1984

[54] PAPERBOARD FOOD CARTON

[75] Inventors: Arne H. Brauner, Peekskill; Mary M. Watson, Bronxville, both of N.Y.

[73] Assignee: International Paper Company, New York, N.Y.

[21] Appl. No.: 445,775

[22] Filed: Nov. 30, 1982

[51] Int. Cl.[3] ..... G09F 3/02

[52] U.S. Cl. ..... 40/312; 40/486; 40/5; 206/459; 229/33

[58] Field of Search ..... 40/312, 5, 486, 306; 206/459; 229/33

[56] References Cited

U.S. PATENT DOCUMENTS

| | | | |
|---|---|---|---|
| 711,240 | 10/1902 | Zaring | 40/5 |
| 2,054,596 | 9/1936 | Ford | 40/312 |
| 3,071,882 | 1/1963 | Eisman et al. | 40/312 |

*Primary Examiner*—Gene Mancene
*Assistant Examiner*—Wenceslao J. Contreras
*Attorney, Agent, or Firm*—Richard J. Ancel

[57] ABSTRACT

A carton serving as a container for a food product, such as a hamburger. The carton in one embodiment is of the so-called clamshell type and includes an upper lid and a lower tray, both the lid and the tray being of generally truncated pyramidal shape. The novel feature of the clamshell carton permits the packager of the food product to indicate on the carton the type of food product therein. One panel of the carton carries a plurality of shutter panels, the shutter panels overlying and normally covering indicia on an indicia panel. With the packaging of a particular food product in the carton, any one of the plurality of the shutter panels is swung out so as to expose corresponding indicia on the indicia panel. By virtue of this construction, a single carton may be employed for the packaging of a variety of generally similarly sized food products. In another embodiment the carton is of the tube type, wherein one of the two ends of the container is provided with the food product indication construction of this invention.

20 Claims, 9 Drawing Figures

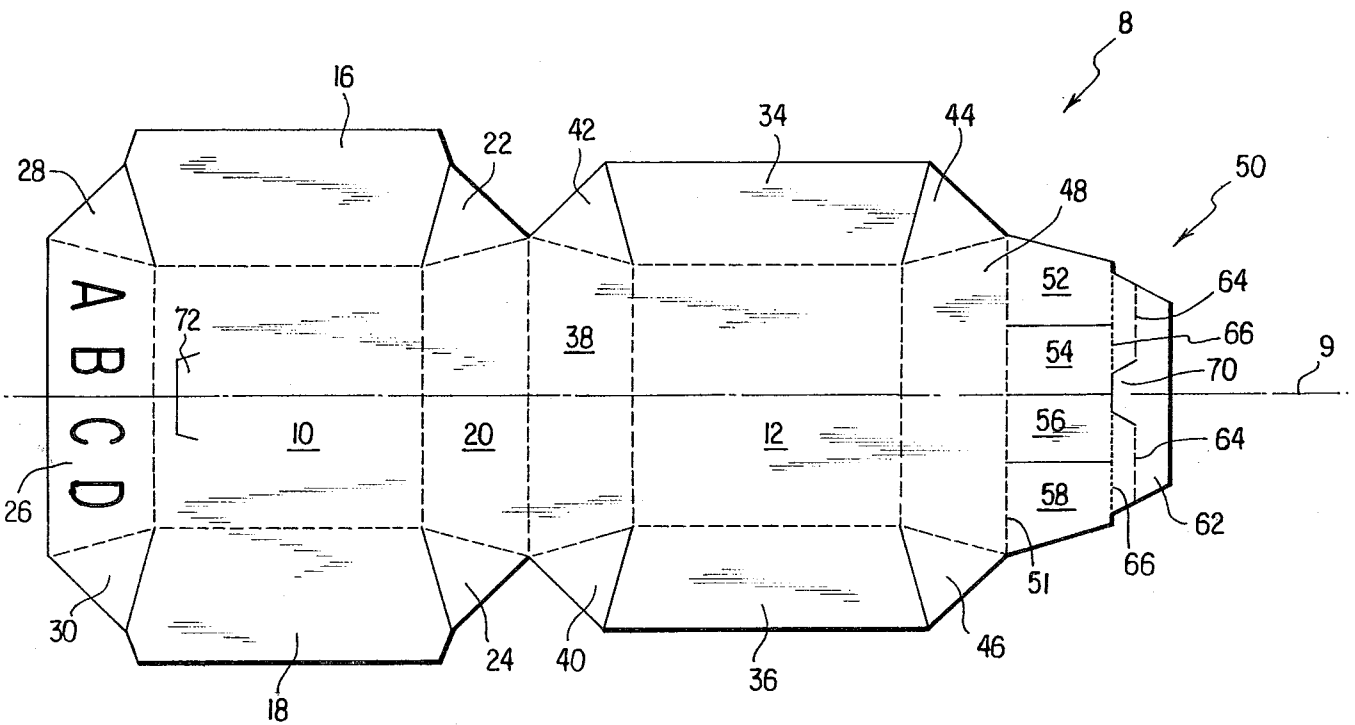
FIG. I
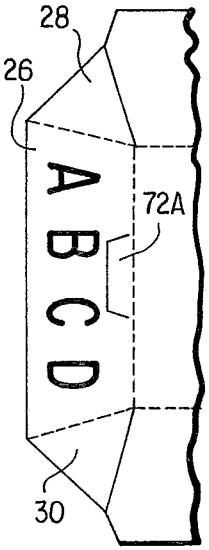
FIG. IA

FIG. 1B
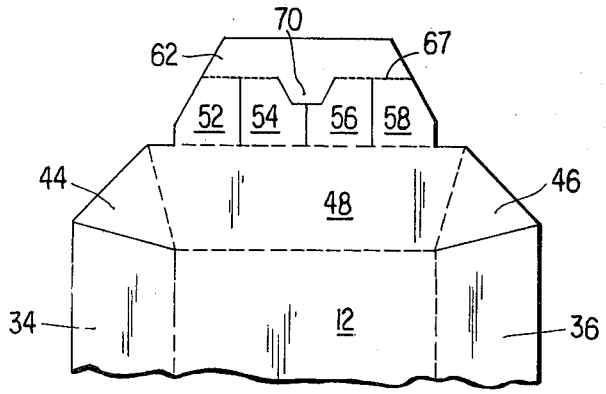
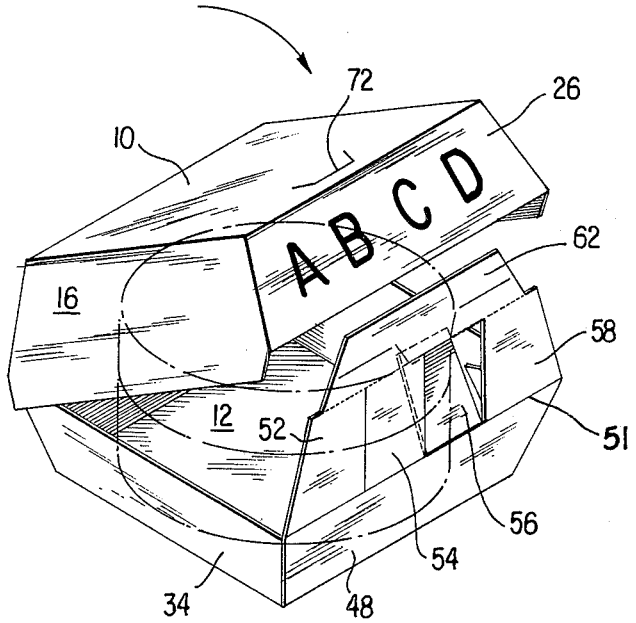
FIG. 3

PAPERBOARD FOOD CARTON

BACKGROUND OF THE INVENTION

This invention relates to a carton particularly adapted for the packaging of food stuffs, such as hamburgers.

In the packaging of food products, particularly so called fast food products such as hamburgers, cheeseburgers, and the like, a variety of cartons or packages for the hamburgers has evolved. Often, the carton is defined by a tray or lower portion and a lid or top portion, the tray and lid being hingedly connected. Such cartons are often formed from a single paperboard blank which is suitably pre-cut and pre-scored and which, when suitably folded and assembled, defines the container. In many so-called fast food outlets, there is a need for a single container which may be used for a variety of food products. In the case where the food product is a sandwich, such as a hamburger, cheeseburger, or the like, it is often the practice to place several different types of food products in one bin or serving zone in a holding area so that vending assistants may merely reach into the appropriate zone or area of storage or the like to select whichever food product a customer desires. While such practice, if carried out properly, results in accurate dispensing of the food products, there arise occasions when this procedure is not practical. For example, if the number of storage areas for each different kind of food product is limited, or if vending personnel make an error, then the wrong food product may be delivered to the purchaser.

SUMMARY OF THE INVENTION

According to the practice of this invention, a carton for a food product such as a hamburger, cheeseburger or the like is provided with variable indicia and means to selectively expose these variable indicia, either at the time of inserting the food product into the carton or prior to such insertion on an assembly line basis, so that the probability of the consumer obtaining a food product other than that desired is reduced. Further, the practice of this invention enables a single carton to function as a container for a variety of food products of similar size and shape, thereby reducing the requirements for storing containers each of a different color or the like to indicate different food products.

The full nature of the invention will be understood from the accompanying drawings and the following description and claims. It should be understood that references in the following description to front; rear and side walls and panels are for convenience of description, and such terms are not intended to be used in a limiting sense.

BRIEF DESCRIPTION OF THE DRAWINGS

FIG. 1 is a plan view of the blank from which the carton of this container is fashioned.

FIG. 1A is a partial view of the blank of FIG. 1, illustrating an embodiment.

FIG. 1B is a partial view of the blank of FIG. 1, illustrating yet another embodiment.

FIG. 3 is a view of the carton of this invention showing the lid just before closing or just after opening.

DETAILED DESCRIPTION OF THE INVENTION

Figure 2:
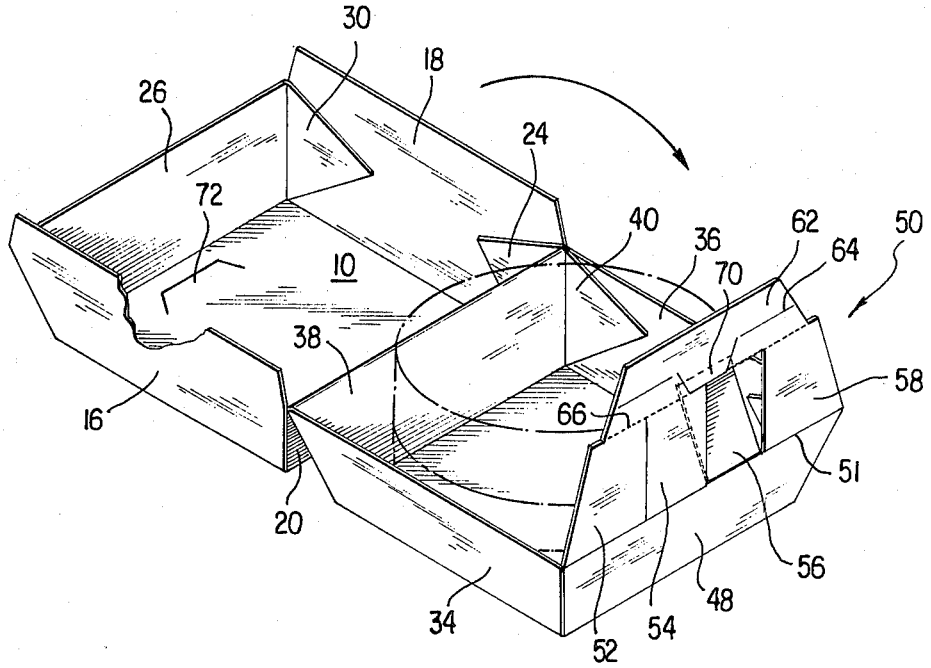
FIG. 2 is a view showing the carton assembled and opened, a food product being shown therein in phantom lines.

Referring now to FIG. 1 of the drawings, the numeral 8 denotes a blank having a longitudinal axis 9 and having an upper or lid forming portion, the lid having a central, rectangular panel 10. The bottom or tray portion of the carton is defined by a central, rectangular panel 12 of the same shape as portion 10. The numerals 16 and 18 each denote a side wall panel hingedly connected, as indicated by the dashed lines, to central panel 10. The numeral 20 denotes a hinge panel for the lid, the hinge panel including triangular glue panels 22 and 24 at each end, hingedly connected to panel 20 as indicated by the dashed lines. The numeral 26 denotes another side wall panel, at one longitudinal end of the blank 8, being an indicia panel, this panel carrying triangular glue panels 28 and 30 hingedly connected thereto as indicated by the dashed lines. The numerals 34 and 36 each denote a side wall panel for the tray, hingedly connected to central portion 12 as indicated by the hinge lines. The numeral 38 denotes a hinge panel on the tray, this hinge panel being hingedly connected to side wall panel 20 and to central portion 12, as indicated by the dashed lines. Hinge panel 38 carries glue panels 40 and 42, hingedly connected thereto by the dashed lines. The numeral 48 denotes another side wall panel carried by the tray, panel 48 carrying triangular glue panels 44 and 46 joined thereto by the indicated dashed lines. The solid lines bordering each of the triangular web panels 28, 30, 22, 24, 42, 40, 44 and 46 denote cuts extending through the paperboard blank.

The elements thus far described are generally known in the art. When the lid 10 and tray 12 are folded together about the hinged junction between hinge panels 20 and 38, a carton is formed of the so called clamshell type, with each of the lid and the tray being of generally truncated pyramidal form. Side wall lid panels 16 and 18, being wider than panels 34 and 36 of the tray, generally overlie and extend past the latter, to provide venting of the contents of the carton.

The numeral 50 denotes a cover panel integrally connected along the dashed hinged line 51 to side wall panel 48. Cover panel 50 includes a plurality of shutter panels 52, 54, 56 and 58. The solid lines separating the four shutter panels denote cuts extending through the paperboard blank. The numeral 62 denotes a locking panel having a hinge line 64. The numeral 66 denotes a perforated hinge line running along the right hand (FIG. 1) ends of the shutter panels. Each shutter panel may accordingly be detached along line 66 and swung away from the plane of cover panel 50.

The numeral 70 denotes a locking tab carried by locking panel 62, the locking tab 70 adapted to be received into slit 72 defined by the indicated three cut lines in central lid panel 10. The base of locking tab 70 is integral with locking panel 62, its two sides are cut through the paperboard as indicated by the solid lines, while its tip is also cut through the paperboard and is colinear with perforated lines 66. FIG. 1 shows the locking slit 72 located in central panel 10. An alternative location of slit 72 which uses less material for the blank 8, is shown at FIG. 1A. There, the locking slit is located on the indicia panel 26 and is denoted by 72A.

Figure 4:
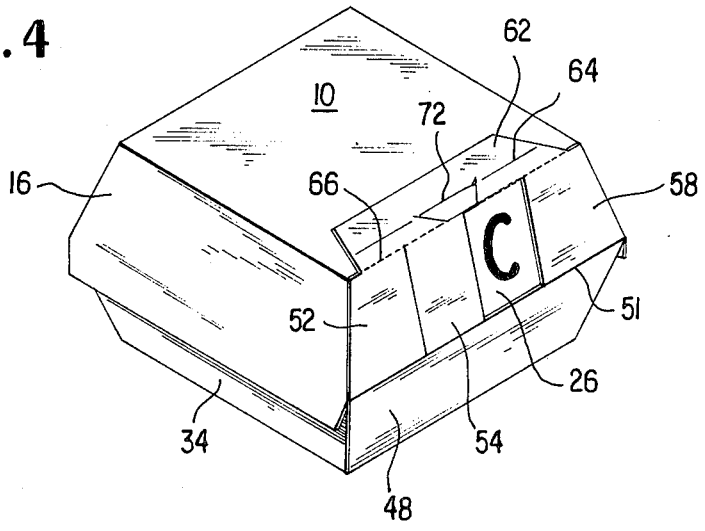
FIG. 4 is a view of the carton of this invention in the closed position, with one shutter panel hinged away to thereby indicate the contents of the carton.

FIGS. 3 and 4 illustrate the carton formed from the blank of FIG. 1. The glue portions 42 and 40 are, respectively, fixed as by gluing to side wall panels 34 and 36. Similarly, glue portions 44 and 46 are affixed to, respectively, side wall panels 34 and 36. Similarly, glue portions 22 and 24 are affixed, as by adhesive, to, respectively, side walls panels 16 and 18, as are triangular glue portions 28 and 30 of indicia panel 26.

As may be seen now from a consideration of FIG. 4, after a food product such as a hamburger has been placed into the tray, as indicated at FIGS. 2 and 3, the lid is closed. Tab 70 is moved out from locking tab 62 and inserted into slit 72. This releasably fastens the lid down on the tray. To open the lid, locking panel 62 is pulled, thus pulling locking tab 70 out of slit 72. The reader will observe that one of the four shutter panels 56 has been swung away about its hinge line 51 to expose one of the indicia, denoted by A, B, C, D of indicia panel 26. Shutter panel 56 is shown in FIGS. 2 and 3 as bent inwardly, but it may be bent outwardly. This bending away of any shutter panel may be done either at the time of the insertion of the food product into the carton just prior to closing it, or it may be done prior to this time. One indicia A may denote a hamburger, another indicia B a cheeseburger, and so on.

In the embodiment of the invention which has been illustrated, the extent of the shutter panels 52, 54, 56 and 58 is substantially equal to the extent of indicia panel 26. This relation is not necessary in the sense of limiting the invention. For example, the lid 10 and tray or bottom 12 with their associated side and glue flap panels may be made non-square, with the longest axis of the lid and tray being at right angles to axis 9 of FIG. 1. The extent of cover panel 50, however, as well as that of the indicia, can remain the same as shown at FIG. 1, Such a variation in proportion of the lid and tray exhibits utility in the dispensing of elongated food products, such as frankfurters of various ingredients and various dressings.

From a consideration of FIGS. 1A and 2–4, the reader will observe that if the locking slit 72 of FIG. 1 is relocated from top panel 10 to indicia panel 26, as at 72A of FIG. 1A, then the extent of the shutter panels may be somewhat reduced. The locking action is otherwise the same as that shown in FIGS. 2–4, namely, locking tab 70 is received by slit 72A.

FIG. 1B illustrates yet another variation in the blank of FIG. 1. Namely, the cover panel 50 is modified by omitting the panel portions between hinge lines 64 and 66. Panel 62 with its locking tab 70 remains, with a single hinge line 67 replacing hinge lines 64 and 66. Locking tab 70 extends somewhat into the innermost shutter panels 54 and 56. Either or both of the modifications of FIGS. 1A and 1B may be incorporated in the blank of FIG. 1. The modifications of FIGS. 1A and 1B are useful in reducing the overall length of the blank, and hence the quantity of paperboard stock required. The mode of operation of the blank of FIG. 1, as modified by FIG. 1A and/or FIG. 1B, is the same as that described with respect to FIG. 1 in forming a container, as shown in FIGS. 2 to 4 inclusive.

Figure 5:
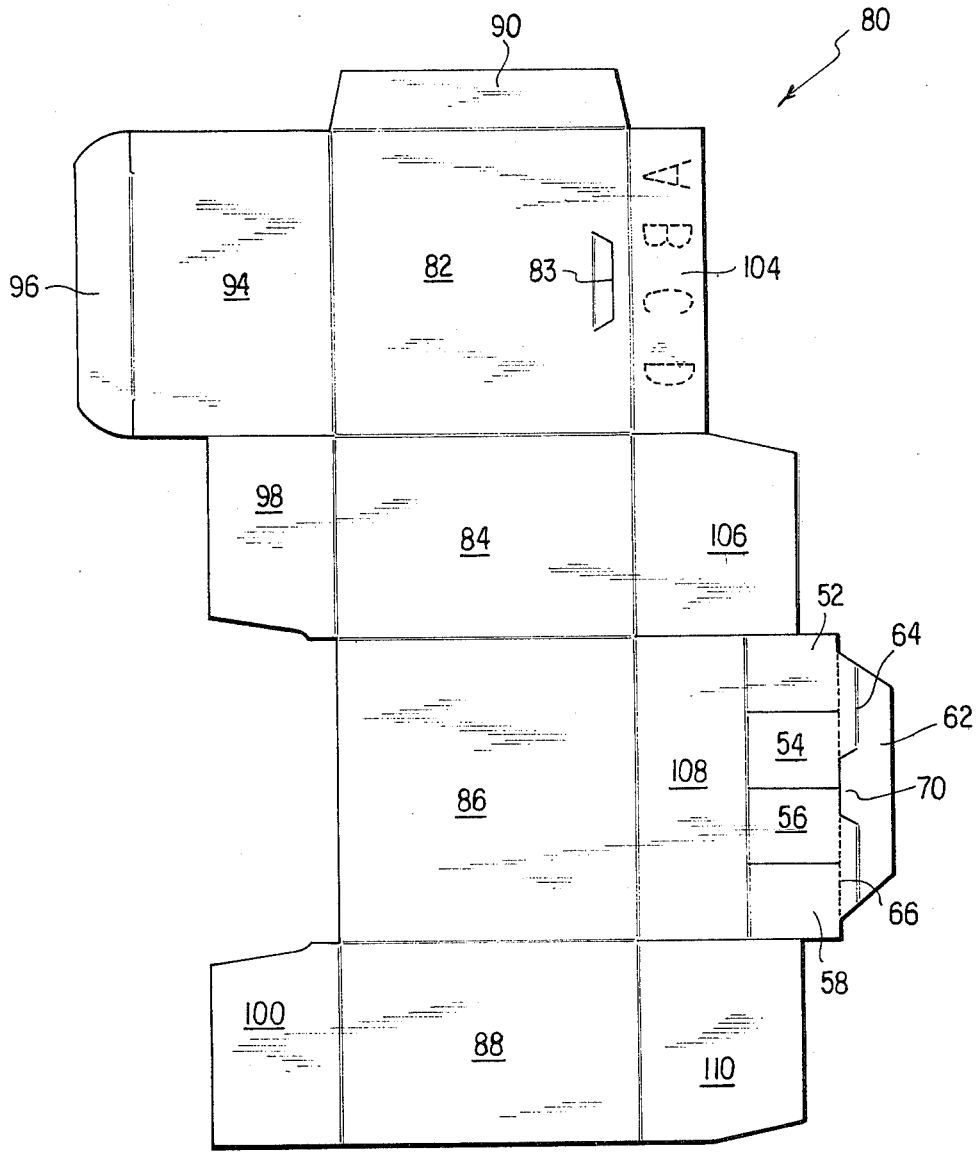
FIG. 5 is a view similar to FIG. 1, and illustrates an embodiment.

Referring now to FIG. 5 of the drawings, a third embodiment of the invention is illustrated. This embodiment employs the same product indicating structure as with the previously described embodiments, but is here illustrated as applied to a tube-type container, also formed of a one-piece, stiff, resilient and foldable sheet material such as paperboard. The numeral 80 denotes generally the blank of FIG. 5, the blank including tube-forming panels 82, 84, 86 and 88 the sides of which are separated by the indicated fold lines. The numeral 90 denotes the usual manufacturer's tab or flap. The numeral 94 denotes an end closure panel integrally attached to panel 82, panel 94 carrying a conventional tuck flap 96 integrally connected thereto. End closure panels 98 and 100 are defined by the indicated fold lines to their respective flaps 84 and 88 at the left edges thereto. The panels 94, 98 and 100 are defined by the indicated fold lines to their respective flaps 84 and 88 at the left edges thereto. The panels 94, 98 and 100 define a conventional end closure for one end of the tube-type container, such as is well known in this art and forms by itself no part of this invention.

The numerals 104, 106, 108 and 110 denote panels connected to the right side of panels 82, 84, 86 and 88 respectively. As will later be seen by reference to FIGS. 6 and 7, panels 104, 106, 108 and 110 define closure panels for the other end of the tube-type container. The printed side of panel 104 carries indicia A, B, C and D, similar to that carried by sidewall 26 of the previously described embodiments. The dashed lines in FIG. 5 indicate that the indicia are on the underside of the blank, as viewed in FIG. 5, the blank being shown with the printed indicia down.

Numerals 52, 54, 56 and 58 denote shutter panels connected to panel 108 along the indicated fold line. Again, the solid lines between the shutter panels indicate cut lines in the paperboard. The numerals 62, 66 and 70 denote the same elements referred to and described with respect to the first described embodiments. The shutter panels and associated panel 62 define a cover panel, analogous to cover panel 50 of FIG. 1.

Figure 6:
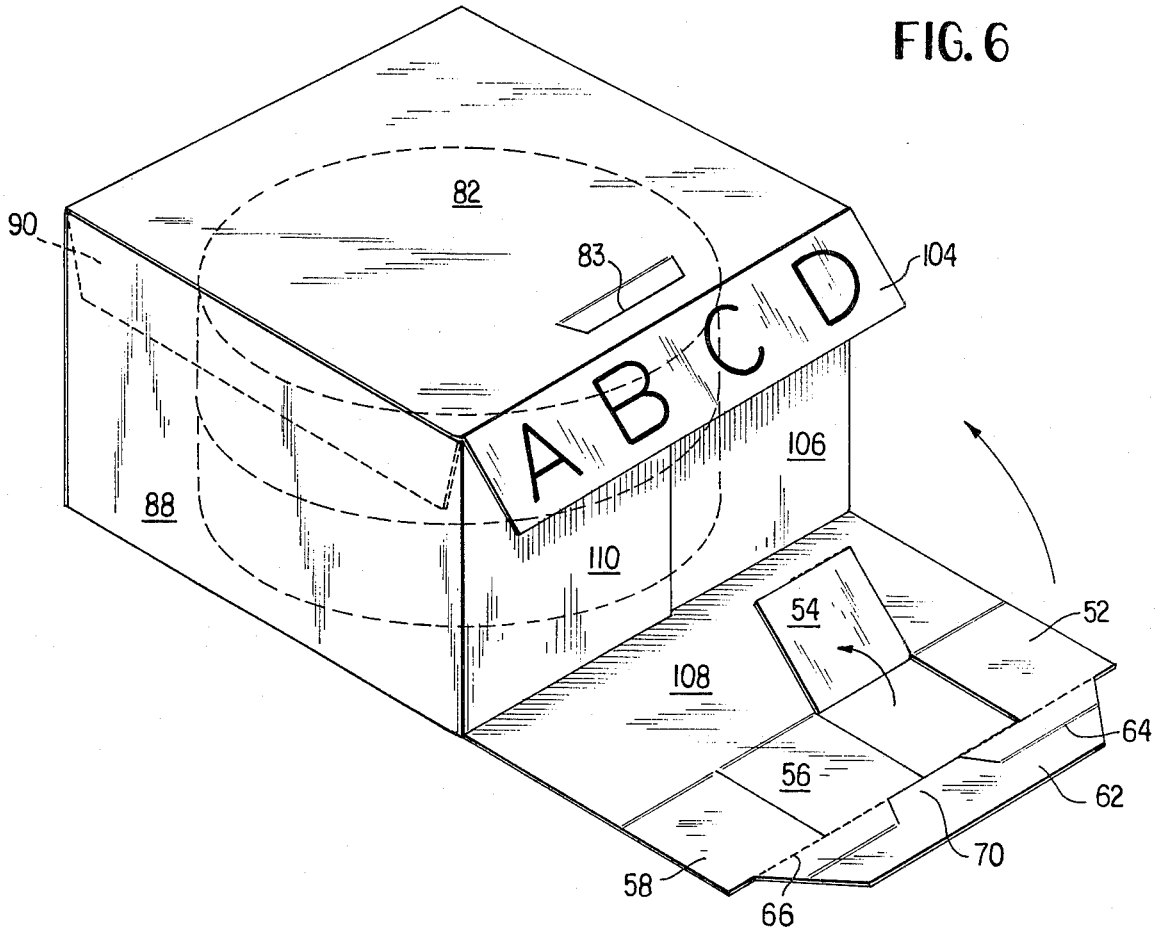
FIGS. 6 and 7 are views similar to FIGS. 2, 3 and 4, and show the manner of assembly and closing of the embodiment of FIG. 5.
Figure 7:
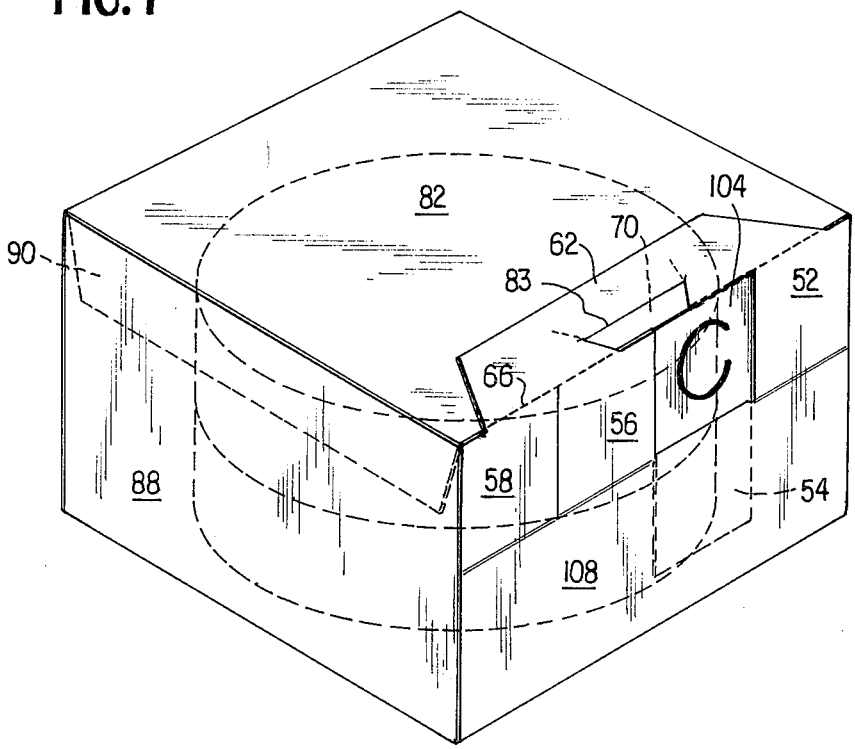

Referring now to FIGS. 6 and 7 of the drawings, the reader will observe that panels 82, 84, 86 and 88 have been folded about the score lines separating them to form a tube-type structure, with the left end of the carton being closed in a conventional manner by panels 94, 96, 98 and 100, all as is well known in the art and which forms by itself no part of this invention. FIGS. 6 and 7 show the manufacturer's flap or tab 90 glued to an interior portion of panel 88, to thereby complete the tube structure. Top panel 82, as previously indicated, carried a slit 83 similar to slit 72 of the first described embodiment.

FIG. 6 indicates an intermediate configuration of the container formed from the blank of FIG. 5. As shown at FIG. 6, indicia carrying panel 104 has been folded down below the plane of panel 82. Panel 108 which carries the shutter panels 52, 54, 56 and 58 is shown as about to be swung upwardly from the plane of bottom panel 86. This latter panel is not shown at FIG. 6 or 7, but is readily visualized from FIG. 5 and is opposite top panel 82 in the erected configuration. End closure panels 106 and 110 assume the position shown in FIG. 6, with the free edge of panel 110 overlying a portion of panel 106. Clearly, the free end of panel 106 could overlie a portion of the free end of panel 110 as well. The reader will observe that a food product such as a hamburger or cheeseburger, indicated in phantom lines at FIGS. 6 and 7, may be carried interiorally of the carton, similar to the food product shown at phantom lines at FIGS. 2 and 3.

To arrive at the completely closed and product-indicating configuration of FIG. 7 from that of FIG. 6, the following steps are taken. After the food product has been placed in the carton, closure panel 108, together with its associated shutter panels and locking tab panel elements, is swung in the direction of the arrow at FIG. 6, with one of the shutters 52, 54, 56 or 58 having been displaced from its original position in the plane of the shutter panels. At FIG. 6, one of the shutter panels, being panel 54, is indicated as in the process of being bent away from this plane, in a manner similar to that indicated at FIG. 2. The shutter panel 54 may now be folded about its base and down onto the interior portion of panel 108, or it may be bent the other way.

At FIG. 7, the completed and fully closed carton is shown, with locking tab 70 having been inserted in cut 83 to thereby releasably close the carton. The absence of the shutter panel 54 from its original position indicates one of the several indicia on the panel 104, to thereby indicate the particular product contents of the closed carton, such as a hamburger, cheeseburger, or the like. If desired, the locking slit 83, which receives locking tab 70, may be located on indicia panel 104 instead on top panel 82, in a manner analogous to the modification shown at FIG. 1A with respect to slit 72A.

U.S. Pat. No. 3,205,603 issued to Brumley shows a carton which can be closed manually by a locking means and offers seven labeling options. The locking means is a simple tuck end closure. The seven options are achieved by removing one or more tabs to expose a message or indicia under each tab. This design has the disadvantage of removable tabs that are so located as to be incompatible with a food packing operation. The message areas are also very small and the act of removing the tabs serves to weaken the structural integrity of the main body panels. The present invention, by comparison, utilizes movable shutter panels which are part of the closure feature. When one of the four option panels is detached from the cover panel, it can be folded into the package, if desired, which serves to reveal indicia through a window. The shutter panel need never be removed form the package and when the carton is finally opened by the user, all four product options are readily exposed which is a positive promotional feature. Because the shutter panels are part of the closing feature, their detachment does not serve to weaken the main body panels.

U.S. Pat. No. 3,071,882 issued to Eisman shows a carton with interchangeable indicia display means. These labeling options are achieved by the use of a fifth panel extension inside of a tube style carton. By manipulation of flaps and tabs in the main body panels, one can achieve a specific message or series of messages. Eisman is limited to a tube style structure and must be employed on a main body panel. The present invention applies to a tube or tray style structure which offers the optional messages as part of the closure mechanism.

U.S. Pat. No. 4,004,691 issued to Wihksne shows a tube style structure that includes four message windows as part of a seal end closure. Each window can have one of two possible messages. The folding and sealing sequence of the end panels determines which the plurality of messages or indicia are seen through the windows. The windows may also be electively punched out to expose a message or left in to reveal no messages. This design bears little resemblence to the present invention because it is dependent on the use of specific end closure panel permutations. Furthermore, when the package of the present invention is opened it reveals all four options to the ultimate user as may be seen by reference to FIGS. 3 and 6. The Wihksne construction is not intended to be fully opened by the ultimate user so as to show all options.

The carton of any embodiment may be made from any suitable foldable material. Preferably, it is made of paperboard or the like, and suitable paperboard stock, for example, is 0.014 SBS. The surfaces of the carton may also be coated with barrier materials to aid in retaining the heat and moisture from the product. For example, the interior and/or exterior of the carton may be coated with materials that act as moisture vapor barriers. The interior of the carton may be coated materials which provide a liquid moisture barrier and provide a degree of grease resistance. It will be recognized, however, that certain food products permit the use of uncoated cartons.

Generally speaking, the present invention is directed to a carton for a food product, and the blank from which it is formed. The carton includes a top lid hingedly connected to a bottom tray by a common hinge line, and the lid and tray each have a generally rectangular central panel from which hingedly extends four side wall panels. One lid side wall panel is a hinge panel hingedly connected to a corresponding hinge side wall panel of the tray to form a hinge connection between the lid and the tray. The tray side wall panel opposite the tray side wall hinge panel carries a cover panel, which lies against and covers an indicia carrying panel. The indicia panel is that lid side wall panel opposite the lid side wall hinge panel. The cover panel has a plurality of shutter panels contained therein, with indicia on the indicia panel covered by the shutters of the cover panel. The indicia are thereby located beneath the cover panel, and any one of the shutter panels is to be swung away from the cover panel to expose that indicia normally covered by it. The indicia behind each shutter panel is different for each shutter panel, whereby the exposed indicia indicates a particular food product in the carton.

While shown as rectangular, the lid and tray of FIGS. 1 to 4 may be round, oval, or of other non-rectangular form.

Although the invention has been described above by reference to several preferred embodiments, it will be appreciated that other carton constructions may be devised, which are, nevertheless, within the scope and spirit of the invention and are defined by the claims appended hereto.

What is claimed is:

1. A clamshell-type carton, the carton including a polygonal central lid, said lid having side wall closure panels foldably connected thereto, a polygonal central tray, said tray having side wall closure panels foldably connected thereto, one side wall of the lid hingedly connected to one side wall of the tray to thereby hingedly join said lid and said tray, a lid side wall closure panel carrying indicia, a corresponding tray side wall closure panel having a cover panel connected thereto, the cover panel having a plurality of shutter panels therein, each shutter panel being individually displaceable from the cover panel, means for fastening the cover panel in overlapping relation to the indicia panel, whereby one of the shutter panels can be displaced from the cover panel to thereby expose indicia therebeneath.

2. The carton of claim 1 wherein each shutter panel is hingable with respect to and away from the cover panel.

3. The carton of claim 1 wherein the carton is formed from a single blank of resilient, stiff and foldable sheet material.

4. The carton of claim 1 wherein at least one of the tray and lid is in the form of a truncated pyramid.

5. The carton of claim 1 wherein the cover panel carries a locking panel, the locking panel defining said means for fastening the cover panel, the locking panel carrying a locking tab insertable into and releasable from a slit carried by one of said indicia panel and central lid.

6. The carton of claim 5 wherein the locking panel is joined to the shutter panels by perforated lines, and wherein one edge of said locking tab is colinear with said perforated lines.

7. The carton of claim 1 wherein the shutter panels are each hingedly connected to the junction of the cover panel with its associated tray side wall closure panel.

8. The carton of claim 1 wherein the cover panel is defined by said plurality of shutter panels and said locking panel.

9. A blank of stiff, resilient and foldable sheet material, the blank adapted to be folded to form a clamshell type container for a food product, the blank including, a polygonal central lid forming portion having side wall closure panels foldably connected thereto, a polygonal central tray forming portion having side wall closure panels foldably connected thereto, one side wall of the lid hingedly connected to one side wall of the tray to thereby hingedly join the lid and tray portions, a lid side wall closure panel carrying indicia, a corresponding tray side wall closure panel having a cover panel connected thereto, the cover panel having a plurality of shutter panels therein, each shutter panel being individually displaceable from the cover panel, means for fastening the cover panel in overlapping relation to the indicia panel, whereby one of the shutter panels can be displaced from the cover panel to thereby expose indicia therebeneath.

10. The blank of claim 9 wherein the cover panel carries a locking panel, the locking panel defining said means for fastening the cover panel, the locking panel carrying a locking tab insertable into a slit carried by one of said indicia and central lid forming portion.

11. The blank of claim 10 wherein the locking panel is joined to the shutter panels by perforated lines, and wherein one edge of said locking tab is colinear with said perforated lines.

12. The blank of claim 9 wherein the shutter panels are each hingedly connected to the junction of the cover panel with its associated tray side wall closure panel.

13. The blank of claim 9 wherein the cover panel is defined by said plurality of shutter panels and said locking panel.

14. A blank of stiff, resilient and foldable sheet material, the blank adapted to be folded to form a container for a food product, the blank including, a plurality of tube-forming panels joined at their sides to each other and separated by fold lines, at least some of said tube-forming panels having at one end of each first means forming a closure for said one end of a tube-type container formed upon bending and folding of the tube-forming panels, the other end of the tube-forming panels provided with second means forming a closure for the said other end of said tube, said second means includng an end closure panel joined to and carrying a cover panel, said cover panel including a plurality of shutter panels, the shutter panels adapted to individually swing away from the cover panel, the second means also including an indicia panel the indicia of which are adapted to be normally obscured by the cover panel of a tube-type container formed from the blank, the cover panel provided with a locking panel which carries means for fastening the cover panel to a panel of the blank, the shutters of the cover panel joined to the locking panel by perforated hinge lines.

15. The blank of claim 14 wherein the locking panel carrying means for fastening the cover panel is defined by a locking tab, one edge of which is cut through the blank and which is colinear with the perforated hinge lines.

16. A tube-type carton, which includes, a plurality of tube-forming side panels joined at their side edges to each other and separated by fold lines, at least some of said side panels having at one end of each first means forming a closure for said one end of said carton formed upon bending and folding of the side panels into the tube, the other end of the side panels provided with second means forming a closure for the said other end of said tube, said second means including an end closure panel joined to and carrying a cover panel, said cover panel including a plurality of shutter panels, the shutter panels adapted to individually swing away from the cover panel, the second means also including an indicia panel, the indicia of which are adapted to be normally obscured by the cover panel of said container, the cover panel provided with a locking panel which carries means for fastening the cover panel to one of said side panels, the shutters of the cover panel joined to the locking panel by perforated hinge lines.

17. The carton of claim 16 wherein the locking panel carrying means for fastening the cover panel is defined by a locking tab, one edge of which is cut through the carton and which is colinear with the perforated hinge lines.

18. The cartons of claim 16 wherever the carton is formed from a single blank of foldable sheet material.

19. The carton of claim 18 wherein the sheet material is paperboard.

20. The carton of claim 19 wherein the adjustment shutter panels are unjoined to each other.

* * * * *